US008282808B2

(12) United States Patent
Hierse et al.

(10) Patent No.: US 8,282,808 B2
(45) Date of Patent: Oct. 9, 2012

(54) USE OF PHOSPHINIC ACIDS AND/OR PHOSPHONIC ACIDS IN REDOX PROCESSES

(75) Inventors: Wolfgang Hierse, Gross-Zimmern (DE); Nikolai Ignatyev, Duisburg (DE)

(73) Assignee: Merck Patent GmbH, Darmstadt (DE)

( * ) Notice: Subject to any disclaimer, the term of this patent is extended or adjusted under 35 U.S.C. 154(b) by 820 days.

(21) Appl. No.: 12/303,006

(22) PCT Filed: May 4, 2007

(86) PCT No.: PCT/EP2007/003966

§ 371 (c)(1), (2), (4) Date: Dec. 1, 2008

(87) PCT Pub. No.: WO2007/140850

PCT Pub. Date: Dec. 13, 2007

(65) Prior Publication Data

US 2009/0166212 A1 Jul. 2, 2009

(30) Foreign Application Priority Data

Jun. 2, 2006 (DE) ..... 10 2006 025 847

(51) Int. Cl.

| | |
|---|---|
| ***C25D 3/56*** | (2006.01) |
| ***C25D 3/00*** | (2006.01) |
| ***C25D 3/04*** | (2006.01) |
| ***C25D 3/10*** | (2006.01) |
| ***C25D 3/22*** | (2006.01) |

(52) U.S. Cl. ..... 205/261; 205/238; 205/283; 205/286; 205/290; 205/305; 205/311

(58) Field of Classification Search ..... 427/430.1, 427/437; 205/238, 261, 283, 286, 290, 305, 205/311

See application file for complete search history.

(56) References Cited

U.S. PATENT DOCUMENTS

| | | | | |
|---|---|---|---|---|
| 2,893,932 | A * | 7/1959 | Haas et al. | 205/276 |
| 3,310,480 | A | 3/1967 | Brown | |
| 3,745,097 | A * | 7/1973 | Chessin et al. | 205/285 |
| 3,912,654 | A | 10/1975 | Heid et al. | |
| 4,006,064 | A | 2/1977 | Niederprum | |
| 4,466,865 | A | 8/1984 | Tomasewski | |
| 4,897,166 | A | 1/1990 | Melzer et al. | |
| 5,126,210 | A | 6/1992 | Wieserman | |
| 5,277,788 | A * | 1/1994 | Nitowski et al. | 205/175 |
| 6,447,666 | B1 | 9/2002 | Szameitat | |

FOREIGN PATENT DOCUMENTS

| | | | |
|---|---|---|---|
| DE | 2110767 | | 9/1972 |
| DE | 2233941 | | 1/1974 |
| EP | 0268075 | A1 | 10/1987 |
| EP | 0299307 | A2 | 7/1988 |
| EP | 0601418 | A1 | 11/1993 |
| GB | 817133 | | 7/1959 |
| GB | 1073670 | | 6/1967 |
| GB | 1096017 | | 12/1967 |
| GB | 1096017 | A * | 12/1967 |
| GB | 1128737 | | 10/1968 |
| GB | 1388924 | | 3/1975 |
| JP | 05247660 | A * | 9/1993 |
| JP | 2005019915 | A * | 1/2005 |
| WO | 0000672 | A2 | 1/2000 |
| WO | 03082884 | A1 | 10/2003 |

* cited by examiner

*Primary Examiner* — Edna Wong

(74) *Attorney, Agent, or Firm* — Millen, White, Zelano & Branigan, P.C.

(57) ABSTRACT

The present invention relates to the use of phosphinic acids and/or phosphonic acids and salts thereof, preferably as surface-active compounds, in redox processes, in particular in electroplating technology, particularly preferably in electroplating baths, and to electroplating baths comprising these compounds.

8 Claims, No Drawings

USE OF PHOSPHINIC ACIDS AND/OR PHOSPHONIC ACIDS IN REDOX PROCESSES

The present invention relates to the use of phosphinic acids and/or phosphonic acids and salts thereof, preferably as surface-active compounds, in redox processes, in particular in electroplating technology, particularly preferably in electroplating baths, and to electroplating baths comprising these compounds.

Electroplating processes, by means of which surface coatings are applied to technical articles or articles of general use, have been known for some time. The surface coatings applied provide the articles with specific functional and/or decorative surface properties, such as, for example, hardness, corrosion resistance, metallic appearance, lustre, etc. In surface coating by electroplating, the metal to be deposited is deposited on the article connected as the cathode by means of direct current from a bath which comprises at least the metal dissolved as salt. The article to be coated generally consists of a metallic material. If the base material is instead not electrically conductive per se, the surface can be made conductive, for example, by means of a thin metallization. Electroplating baths which comprise nickel or chromium usually serve in technical applications for the production of particularly hard, mechanically resistant layers.

Of particular technical relevance is, for example, the application of chromium in electroplating processes, either for decorative applications or as hardening coating for articles in technical applications. In the case of decorative applications, bright and highly reflective chromium layers are desired. In the case of technical applications (also known as "hard chrome plating"), the chromium layers applied should be low-wear, heat-resistant, corrosion-resistant and abrasion-stable. Chrome-plated articles of this type are, for example, pistons, cylinders, cylinder liners or journal bearings.

Electrochrome-plating is usually carried out in electroplating baths comprising chromium(VI) salts and sulfuric acid using insoluble lead/antimony or lead/tin anodes. The most common chromium(VI) salt here is $CrO_3$. Owing to the health- and environment-endangering properties of Cr(VI) solutions, it has alternatively been proposed to employ electroplating baths comprising Cr(III) salts. However, it has been found that the chromium layers obtained from Cr(III) solutions have a microstructure, which is particularly undesired in technical applications. For this reason, chrome-plating by means of chromium(VI) continues to be of particular technological importance.

A major problem in electroplating processes, in particular in chrome-plating by means of chromium(VI) solutions, is the gas evolution that occurs, in particular of hydrogen, and to a small extent also the anodic evolution of oxygen, which results in the formation of acidic, corrosive and in some cases also toxic spray mist. In order to counter this, surface-active substances, for example surfactants, are usually added to the electroplating bath.

Thus, U.S. Pat. No. 4,006,064 proposes to employ quaternary ammonium perfluoroalkanesulfonates as surface-active substance in chrome-plating. Accordingly, the chemically related perfluorooctanesulfonic acid (PFOSA) is frequently employed today in chrome-plating. In recent years, however, the use of this compound has been increasingly restricted since the compound is not biodegradable, accumulates in tissues and has an accumulative toxicity.

There is thus an urgent demand for the use of alternative surface-active substances in electroplating baths which are more readily degradable, have adequate stability to acid and high electrochemical stability and in addition are able to reduce the formation of undesired spray mist during electroplating.

Accordingly, the object of the present invention is to find alternative surface-active compounds for use in electroplating baths which additionally meet the above-mentioned criteria.

The above-mentioned object is achieved by the use of phosphinic acids and/or phosphonic acids or salts thereof, in particular as surface-active substances in redox processes, in particular in electroplating technology, preferably in electroplating baths, in particular in electroplating baths for chrome-plating.

For the purposes of the present invention, redox processes are taken to mean all processes in which metal layers are deposited on a support either by electrochemical methods or by chemical redox reactions or existing layers on the surface are correspondingly modified by redox reactions. The chemical redox reactions are usually processes of currentless surface treatment, which is usually carried out with chemical agents. Processes of this type are known to the person skilled in the art.

For the purposes of the present invention, electroplating technology is taken to mean in the broadest sense all types of electrochemical surface treatment of materials that are known to the person skilled in the art. In the case of electrochemical surface treatment, this is usually carried out via electrolytic deposition or conversion of metallic or nonmetallic layers, in particular for the purposes of decoration, corrosion protection or the production of composite materials having improved properties. For the purposes of the present invention electroplating technology is taken to mean, in particular, both electroforming, electroplating and also electrochemical passivation.

Electroforming serves for the production or reproduction of articles by electrolytic deposition. To this end, an impression (negative, hollow mold) of plaster, wax, gutta-percha, silicone rubber, low-melting metal alloys, etc., of the original mould is firstly produced. The casting is made electrically conductive on the surface (by chemical deposition or vapour deposition of metals) and then, as negative pole in the electroplating liquid, coated with the metal to be deposited (for example Cu, Ni, Ag, etc.; positive pole). After completion of the electrolysis, the metal layer formed can be lifted off the mould and optionally lined with filling material for reinforcement.

The electroplating technology in accordance with the present invention is preferably electroplating, a process for the coating of articles with usually very thin, protective and decorative coatings of, for example, silver, gold, nickel, chromium, copper, zinc, aluminium and the like on less valuable substrates (for example made of iron) with the aid of electrical current. For the purposes of the present invention, the term electroplating technology also encompasses electrochemical passivation processes, which are known to the person skilled in the art, for example, under the term eloxal processes. For the purposes of the present invention, eloxal processes are taken to mean, in particular, electrolytic processes for the anodic oxidation of aluminium and aluminium alloys, by means of which a significantly reinforced oxide protective layer is produced on the workpiece surface. Corresponding eloxal processes by means of which decorative or technical functional oxide layers are produced are known to the person skilled in the art. Advantages of the layers are strong adhesion, thickness up to 30 μm, corrosion protection, hardness and wear resistance, a decorative action, mechanical resistance, electrical insulation and toxicological acceptability.

The use according to the invention is preferably directed to electroplating in the form of electroplating baths.

The phosphinic acids employed or salts thereof are preferably those of the general formula (I)

$$Rf^1Rf^2P(O)O—X \quad (I)$$

where $Rf^1$ and $Rf^2$ each, independently of one another, denote branched or unbranched alkyl chains of the formula $C_nF_{2n-z+1}H_z$, where n=2-8, z=0-3 and in which X=H, an alkali metal, ammonium or phosphonium. Compounds of the general formula (I) are known from WO 03/082884, where they are employed in optical systems.

The phosphonic acids or salts thereof are those of the general formula (II)

$$Rf^1P(O)(O—X)(O—X') \quad (II)$$

where $Rf^1$ denotes branched or unbranched alkyl chains of the formula $C_nF_{2n-z+1}H_z$, where n=2-8, z=0-3 and in which X and X', independently of one another, denote H, an alkali metal or ammonium or phosphonium.

In accordance with the invention, X and X'=an alkali metal, in particular lithium, sodium or potassium, preferably potassium or sodium.

In the case of X=ammonium, the ammonium cation can be selected from those of the general formula (III)

$$[NR_4]^+ \quad (III),$$

where

R in each case, independently of one another, denotes

H, straight-chain or branched alkyl having 1-20 C atoms, saturated cycloalkyl having 3-7 C atoms, aryl or alkyl-aryl, which may be substituted by alkyl groups having 1-6 C atoms, where one or more R may be partially or fully substituted by halogens, in particular —F.

In the case of X=phosphonium, the phosphonium cation can be selected from those of the general formula (IV)

$$[PR_4]^+ \quad (IV),$$

where

R in each case, independently of one another, denotes

H, with the restriction that not all R are simultaneously H, straight-chain or branched alkyl having 1-20 C atoms, saturated cycloalkyl having 3-7 C atoms, aryl or alkyl-aryl, which may be substituted by alkyl groups having 1-6 C atoms, where one or more R may be partially or fully substituted by halogens, in particular —F.

In the case of the said phosphinic acids or salts thereof, $Rf^1$ and $Rf^2$ may be identical or different; $Rf^1$ and $Rf^2$ are preferably identical. In the case of the said phosphonic acids, X and X' may be identical or different; X and X' are preferably identical.

The alkyl chains of $Rf^1$ and $Rf^2$ are preferably unbranched. Particularly preferred phosphinic acids of the formula (I) or phosphonic acids of the formula (II) are those where n=2, 3, 4 or 6, z=0 and X=H or an alkali metal, ammonium or phosphonium, in particular where X=H or an alkali metal. The following phosphinic acids are accordingly particularly preferred: $(C_2F_5)_2P(O)OH$, $(C_3F_7)_2P(O)OH$, $(C_4F_9)_2P(O)OH$ and $(C_6F_{13})_2P(O)OH$ and the corresponding alkali metal, ammonium and phosphonium salts. Accordingly, $(C_2F_5)P(O)(OH)_2$, $(C_3F_7)P(O)(OH)_2$, $(C_4F_9)P(O)(OH)_2$ and $(C_6F_{13})P(O)(OH)_2$ and the corresponding alkali metal, ammonium or phosphonium salts are the preferred phosphonic acids.

In a further embodiment of the present invention, the phosphinic acids and/or phosphonic acids can be employed in combination with further surface-active substances. Suitable for this purpose are basically all types of surface-active substance known to the person skilled in the art; the surface-active substances are preferably selected from the group of the perfluoroalkylsulfonates, in particular perfluorooctylsulfonic acid (PFOSA) or salts thereof. However, the use of the phosphinic acids and/or phosphonic acids frequently enables the proportion of surface-active substance to be added to be reduced.

The said phosphinic and phosphonic acids and salts thereof prove to be particularly stable under the conditions prevailing in bath solutions of current-based and currentless redox processes. Thus, the said phosphinic and phosphonic acids are also resistant to strongly acidic and strongly oxidising media, such as, for example, hot chromic acid, have high electrochemical stability and in redox processes result in bath solutions having low surface tension. The reduction in the surface tension can have the following considerable benefits on application:

1. The wetting of the workpieces to be treated is improved, which reduces irregularities in the surface treatment.
2. The wetting of dispersed solid particles (for example of fluoropolymer particles in certain variants of the currentless nickel process) is simplified.
3. On removal of the workpieces from the bath, running-off and dripping-off of the bath solution is simplified. This reduces the loss of material from the bath and increases the service life of the bath solution, which represents a direct economic advantage.
4. The formation of foam on the surface of the bath is simplified, and/or the energy liberated during bursting of bubbles is reduced. This results in the reduction of potentially toxic spray mist and thus in an improvement in occupational safety, in particular in current-based processes which are accompanied by gas evolution.

In addition, the phosphinic and phosphonic acids can be hydrolysed in alkaline media, where non-environmentally harmful hydrocarbons $R_fH$ form which are able to photooxidise in the atmosphere and have zero ozone-damaging potential. This is particularly advantageous compared with the use of perfluoroalkylsulfonic acids and salts thereof, since the spent electroplating baths can now be treated chemically more easily with destruction of the surface-active substance. The complete or partial replacement, claimed in accordance with the invention, of perfluoroalkylsulfonic acids and salts thereof in the bath solutions of current-based or currentless redox processes reduces the liberation of persistent, toxic and bioaccumulative perfluoroalkylsulfonic acids, such as, for example, perfluorooctylsulfonate, into the environment.

In addition, the said compounds have the advantage that, when they are used in electroplating baths, there is a reduced risk of long-term environmental pollution with non-degradable chemical waste.

The phosphinic acids and/or phosphonic acids and salts thereof are in principle suitable for all electroplating baths known to the person skilled in the art, in particular electroplating baths for chrome-plating. Electroplating baths for chrome-plating in particular have a high toxic potential, and consequently spray mists can be reduced in particular during chrome-plating. Owing to the high oxidation potential of the Cr(VI) salts dissolved in the electroplating baths, particularly high requirements of the chemical and electrochemical stability of the surface-active substances are made in the case of these baths, which requirements are met by the said phosphinic acids and phosphonic acids and salts thereof.

Accordingly, the present invention likewise relates to electroplating baths, in particular for chrome-plating, comprising phosphinic acids and/or phosphonic acids and salts thereof, in particular those of the general formulae (I) and (II). Preference is given to electroplating baths which comprise $(C_2F_5)_2P(O)OH$, $(C_3F_7)_2P(O)OH$, $(C_4F_9)_2P(O)OH$, $(C_6F_{13})_2P(O)OH$, $(C_2F_5)P(O)(OH)_2$, $(C_3F_7)P(O)(OH)_2$, $(C_4F_9)P(O)(OH)_2$ and/or $(C_6F_{13})P(O)(OH)_2$ or the corresponding alkali metal salts.

The electroplating baths according to the invention are in principle suitable for any type of electroplating process, in particular for zinc-plating or chrome-plating, both for decorative applications and also for hardening coatings in the case of articles in technical applications.

In the case of zinc, all electrozinc-plating processes known to the person skilled in the art are suitable for use in accordance with the present invention. These are usually carried out by application of a zinc coating in aqueous electrolytes by means of direct current. Mostly acidic, but also alkaline cyanide-free or cyanidic electrolytes are used. The thickness of the applied zinc layer is 2.5 to 25 μm.

The electroplating baths are preferably baths for chrome-plating, for eloxal processes or electroplating baths for zinc-plating.

The electroplating bath according to the invention for chrome-plating particularly preferably comprises Cr(VI) ions in an amount which corresponds to 200 to 400 g/l, in particular 220 to 270 g/l and very particularly preferably 250 g/l. The compound supplying Cr(VI) ions is preferably selected from chromic anhydride ($CrO_3$) and/or alkali metal dichromates, such as $Na_2Cr_2O_7$ and $K_2Cr_2O_7$. Of the alkali metal dichromates, $K_2Cr_2O_7$ is preferred. In a particularly preferred embodiment, the compound supplying Cr(VI) ions is chromic anhydride. In a further embodiment, part of the compound supplying Cr(VI) ions is one or more alkali metal dichromate(s), in particular potassium dichromate. In this embodiment, preferably less than 30% by weight and particularly preferably less than 15% by weight of the Cr(VI) ions are supplied by alkali metal dichromate.

The electroplating baths for chrome-plating furthermore preferably comprise sulfate ions in the form of sulfuric acid and/or a soluble salt of sulfuric acid. The soluble salts of sulfuric acid which can be employed are preferably selected from sodium sulfate, potassium sulfate, lithium sulfate, ammonium sulfate, magnesium sulfate, strontium sulfate, aluminium sulfate and potassium aluminium sulfate. The molar concentration ratio of Cr(VI) ions to sulfate ions in the electroplating bath is usually 80:1 to 1:25:1, preferably 95:1 to 105:1 and very particularly preferably 100:1.

In addition, the electroplating baths according to the invention may furthermore comprise additional additives and auxiliaries, such as, for example, conductive salts, wetting agents and foam-inhibiting additives. The use of these auxiliaries in electroplating baths is adequately known to the person skilled in the art. Furthermore, the electroplating baths may comprise additional surface-active compounds, in particular those from the group of the perfluoroalkylsulfonates.

The electroplating bath according to the invention for chrome-plating can be employed in all electroplating plants known to the person skilled in the art and with the standard working procedures therein and for the usual coating purposes here on the base materials usually provided. Such base materials can be, for example, articles made from conductive materials, such as metal, in particular steel, and metallised, non-conductive articles, for example made from plastics. The said articles can have any desired shape here. The coating of plastics is usually also known as plastic electroplating. Plastic electroplating (also known as plastic metallisation) here is taken to mean the electrocoating of a plastic with a metal layer.

The advantages of plastics as base material are multifarious. Low weight, insensitivity to corrosion, inexpensive production of the blanks by injection moulding and omission of mechanical surface treatment are the main reasons which make plastics interesting as base material. Whereas, for example, the base material employed in the automobile industry for electroplated external parts (door handles, lettering, ornamental trim, radiator grilles, etc.) used to be exclusively metals (steel, brass, zinc die casting), they have today been virtually completely replaced by electroplated plastics. The use is multifarious and runs through all branches of industry, not only for decorative, but also for technical purposes, such as, for example, shielding of mobile telephones.

Plastics are usually not electrically conductive, so the surface must firstly be covered with a strongly adherent, electrically conductive layer for subsequent electrolytic coating. Various processes are in principle available for this purpose:

PVD (physical vapour deposition)
PECVD (physical enhanced chemical vapour deposition)
thermal spraying
chemical coating with the aid of palladium activation
chemical etching processes (chemical binding forces)
plasma pretreatment (physical binding forces)
mechanical roughening (mechanical binding forces)

Depending on the process, various plastics can be coated and various adhesive strengths achieved. The individual processes can be summarised as follows:

PVD:

In a high vacuum, a 'target' (coating material) is bombarded with particles. Layer thicknesses of up to 3-5 μm are generally deposited by detachment of the coating material and acceleration onto the substrate. Coatable plastics must, in particular, be suitable for evacuation. This is crucially affected by the outgassing behavior and the water absorption of the plastic.

PECVD:

Pure [CVD] (chemical vapour deposition) processes facilitate the deposition of materials by chemical reaction at >500° C. Plastics generally do not withstand these temperatures. In order to reduce the process temperature, combined PVD and CVD processes can be used (PECVD).

Thermal Spraying:

Due to heating of coating material, detachment and acceleration of particles and bombardment of the substrate material, the particles solidify on the surface. Layer thicknesses are usually in the region >50 μm.

Chemical Etching Processes:

Not every plastic is suitable for electrocoating with the aid of chemical etching processes. In industry, electroplating of ABS (acrylonitrile-butadiene-styrene copolymer) and ABS-PC plastics is the most widespread. Other plastics, such as PA 6.6, PEI, LCP (palladium-doped) can likewise be metallised using these processes.

The first step in the electroplating of ABS plastics is roughening of the surface. In a chromic/sulfuric acid pickling bath, a constituent of the ABS, the butadiene, is dissolved out of the surface, and caverns form in the microscopic range. Palladium nuclei surrounded by a tin sheath are incorporated into these caverns. In a further step, the tin sheath, which ensures adhesion of the nucleus in the caverns, is removed to such an extent that the nucleus is exposed. In the subsequent step, the chemical (external currentless) nickel-plating, the high standard potential of the palladium ensures initiation of the reaction. A reducing agent, which is itself oxidised, releases the electrons necessary for the deposition of nickel here. This results in the formation of the first thin conductive nickel layer, which has strong mechanical dovetailing with the plastic due to the filling of the caverns and adheres correspondingly well.

A conventional system can then be built up on this layer, and, for example, a copper/nickel/chromium system, as is widespread in decorative electroplating technology, can be applied.

Plasma Coating:

A plasma is generated in a vacuum oven. By physical reaction of the plasma of the plastic surface, modifications occur to the surface which improve the metallizability.

Mechanical Roughening:

Roughening processes, such as grinding, sand-blasting, polishing, inter alia, enable the surface of the plastic to be mechanically modified in order to produce a mechanical attachment.

A combination of these processes is, for example, the META-COAT process.

The present invention furthermore relates to the use of the electroplating baths according to the invention for the application of metal layers, in particular chromium layers. The present invention likewise relates to processes for the application of metal layers, in which the electroplating baths according to the invention are used. The processes according to the invention are preferably used for the application of chromium layers.

The processes according to the invention have the advantage that they are simpler to carry out with respect to occupational safety and, after corresponding work-up, result in fewer environmentally hazardous residues.

The electroplating bath according to the invention is advantageously employed in the processes according to the invention at temperatures between 30 and 70° C. For decorative applications, temperatures of, in particular, 30 to 50° C. and particularly about 43° C. are used. In technical applications, the temperature is usually 40 to 65° C. and in particular 50 to 60° C.

The current densities employed in the application of chromium layers are usually 7.0 to 65 A/dm$^2$. For decorative applications, current densities of, in particular, 7.5 to 17.5 A/dm$^2$, for technical applications 30 to 65 A/dm$^2$, in particular, are employed.

Even without further comments, it is assumed that a person skilled in the art will be able to utilise the above description in the broadest scope. The preferred embodiments and examples should therefore merely be regarded as descriptive disclosure which is absolutely not limiting in any way.

EXAMPLES

A) Measurement of the Reduction in Surface Tension $(C_4F_9)_2P(O)OH$ is dissolved in various concentrations in distilled water. The surface tension of the resultant solutions is measured using the ring method. To this end, in each case about 80 ml of the solution to be measured are transferred into the measurement dish and placed in the surface-tension measurement instrument (model K12, manufacturer Kruss, Hamburg). The actual measurement is begun after approximately 15 minutes in order to achieve temperature equalisation to 20° C. (±0.2° C.). After manual raising of the sample vessel to beneath the ring, the automatic measurement run is started. The instrument determines the static surface tension taking into account the geometrical data of the ring and the sample dish, with the force being measured that is necessary to move the ring out of the solution without the liquid lamella tearing off. The measurement system is set so that a standard deviation of ±0.05 mN/m is accepted for the end value (mean of 10 individual measurements). The measurement protocol which is printed out after this target value has been reached contains all relevant measurement data.

The results are reproduced in Table 1 and show that the addition of phosphinic acid results in a significant reduction in the surface tension of the solution.

TABLE 1

Measurement of the surface tension

| Solution | Concentration [g/l] | Surface tension [mN/m] |
|---|---|---|
| Water | 0 | 72 |
| Water/PFOS | 1 | 32 |
| Water/$(C_4F_9)_2P(O)OH$ | 0.5866 | 49.36 |
| Water/$(C_4F_9)_2P(O)OH$ | 1.1732 | 44.80 |
| Water/$(C_4F_9)_2P(O)OH$ | 1.7598 | 44.51 |

B) Stability in Chromic Acid 600 mg of $(C_4F_9)_2P(O)OH$ are mixed with 10 ml of a solution containing Cr(VI) ions (300 g/l of $CrO_3$ and 3 g/l of $H_2SO_4$). The mixture is heated at 65° C. for 48 hours. The phosphinic acid is determined in chemically unmodified form after heating by means of $^{19}F$- and $^{31}P$-NMR analysis. $(C_4F_9)_2$ P(O)OH is thus stable to hot chromic acid.

C) Electrochemical Stability

A cyclic voltammogram (CV) of 1-ethyl-3-methylimidazolium bis(pentafluoroethyl)phosphinate is measured in acetonitrile at a concentration of 0.5 M and at room temperature. A glassy carbon electrode (gc) is used as working electrode, a Pt electrode as counterelectrode and an $Ag/AgNO_3$ $(CH_3CN)$ electrode as reference electrode. The potential values are standardised to E° of ferrocene.

An oxidation potential E(ox) of 3.6 V and a reduction potential E(red) of −2.6 V are determined. The measurements confirm that compounds containing the $(C_2F_5)_2P(O)O$ anions are stable to electrochemical oxidation and are suitable for use in electroplating baths for chrome-plating.

D) Degradability 4.5 ml of 20% NaOH are added to 450 mg of $(C_4F_9)_2P(O)OH$. A precipitate of $(C_4F_9)_2P(O)ONa$ forms. The precipitate dissolves completely within three days with formation of $(C_4F_9)P(O)(ONa)_2$ and $C_4F_9H$.

The invention claimed is:

1. In a method of conducting a redox process of electroplating using a surface active agent, comprising coating metal layers on a surface by said redox process of electroplating employing the surface active agent, the improvement wherein the surface active agent is a phosphinic acid and/or phosphinic acid salt of formula (I)

$$Rf^1Rf^2P(O)O—X \quad (I)$$

where $Rf^1$ and $Rf^2$ each, independently of one another, denote branched or unbranched alkyl chains of the formula $C_nF_{2n-z+1}H_z$, where n=2-8, z=0-3 and in which X=H, an alkali metal or ammonium or phosphonium.

2. The method of claim 1, employing the surface active agent in an electroplating bath.

3. The method of claim 1, wherein the surface active agent is a phosphinic acid that is $(C_2F_5)_2P(O)OH$, $(C_3F_7)_2P(O)OH$, $(C_4F_9)_2P(O)OH$, and $(C_6F_{13})_2P(O)OH$ or corresponding alkali metal salts thereof.

4. The method of claim 1, wherein the redox process of electroplating is chrome-plating in an electroplating bath.

5. The method of claim 1, wherein the redox process of electroplating is zinc-plating in an electroplating bath.

6. The method of claim 1, wherein the phosphinic acid is employed in combination with further surface-active substances.

7. The method of claim 6, wherein the further surface-active substance is a perfluoroalkylsulfonate.

8. The method of claim 1, wherein the surface active agent is a phosphinic acid or salt of formula I wherein z is 0.

* * * * *